US007360877B2

(12) United States Patent
Ikezaki et al.

(10) Patent No.: US 7,360,877 B2
(45) Date of Patent: Apr. 22, 2008

(54) INKJET PRINTER

(75) Inventors: Yoshiyuki Ikezaki, Nagoya (JP); Takao Hyakudome, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 76 days.

(21) Appl. No.: 10/803,671

(22) Filed: Mar. 18, 2004

(65) Prior Publication Data

US 2004/0189756 A1 Sep. 30, 2004

(30) Foreign Application Priority Data

Mar. 26, 2003 (JP) ..... 2003-084515

(51) Int. Cl.
*B41J 2/175* (2006.01)

(52) U.S. Cl. ..... 347/85; 347/86

(58) Field of Classification Search ..... 347/7, 347/19, 85, 86, 87; 141/2, 18
See application file for complete search history.

(56) References Cited

U.S. PATENT DOCUMENTS

| | | | | |
|---|---|---|---|---|
| 5,889,543 | A * | 3/1999 | Miyazawa et al. | 347/86 |
| 6,164,766 | A * | 12/2000 | Erickson | 347/85 |
| 6,247,807 | B1 * | 6/2001 | Yang et al. | 347/87 |
| 6,454,400 | B1 * | 9/2002 | Morita et al. | 347/86 |
| 6,467,890 | B1 * | 10/2002 | Tajima et al. | 347/87 |
| 6,619,776 | B2 * | 9/2003 | Yoshiyama et al. | 347/7 |
| 6,659,599 | B2 * | 12/2003 | Putman et al. | 347/86 |
| 6,796,643 | B2 * | 9/2004 | Higuma et al. | 347/85 |
| 6,814,433 | B2 * | 11/2004 | Putman et al. | 347/86 |

FOREIGN PATENT DOCUMENTS

| | | |
|---|---|---|
| JP | 5201015 | 8/1993 |
| JP | 6344554 | 12/1994 |
| JP | 10329330 | 12/1998 |
| JP | 11123833 | 5/1999 |
| JP | 11245400 | 9/1999 |
| JP | 2001260357 | 9/2001 |
| JP | 2001328279 | 11/2001 |
| JP | 2002144600 | 5/2002 |
| JP | 2002205413 | 7/2002 |
| JP | 2002240315 | 8/2002 |

* cited by examiner

*Primary Examiner*—Anh T. N. Vo
(74) *Attorney, Agent, or Firm*—Day Pitney LLP

(57) ABSTRACT

An inkjet printer includes an inkjet head that ejects ink onto a recording medium, a movable ink tank having an ink introducing opening, an ink storing space for storing ink introduced through the ink introducing opening, and an ink discharging opening for discharging the ink of the ink storing space into the inkjet head, and a carriage that supports the inkjet head and the movable ink tank and reciprocates in a direction perpendicular to a feeding direction of the recording medium. The movable ink tank includes a partition wall extending in a direction perpendicular to a reciprocating direction of the carriage to divide the ink storing space into multiple rooms being in fluid communication with each other at upper portions thereof.

42 Claims, 6 Drawing Sheets

INKJET PRINTER

BACKGROUND OF THE INVENTION

Figure 1:
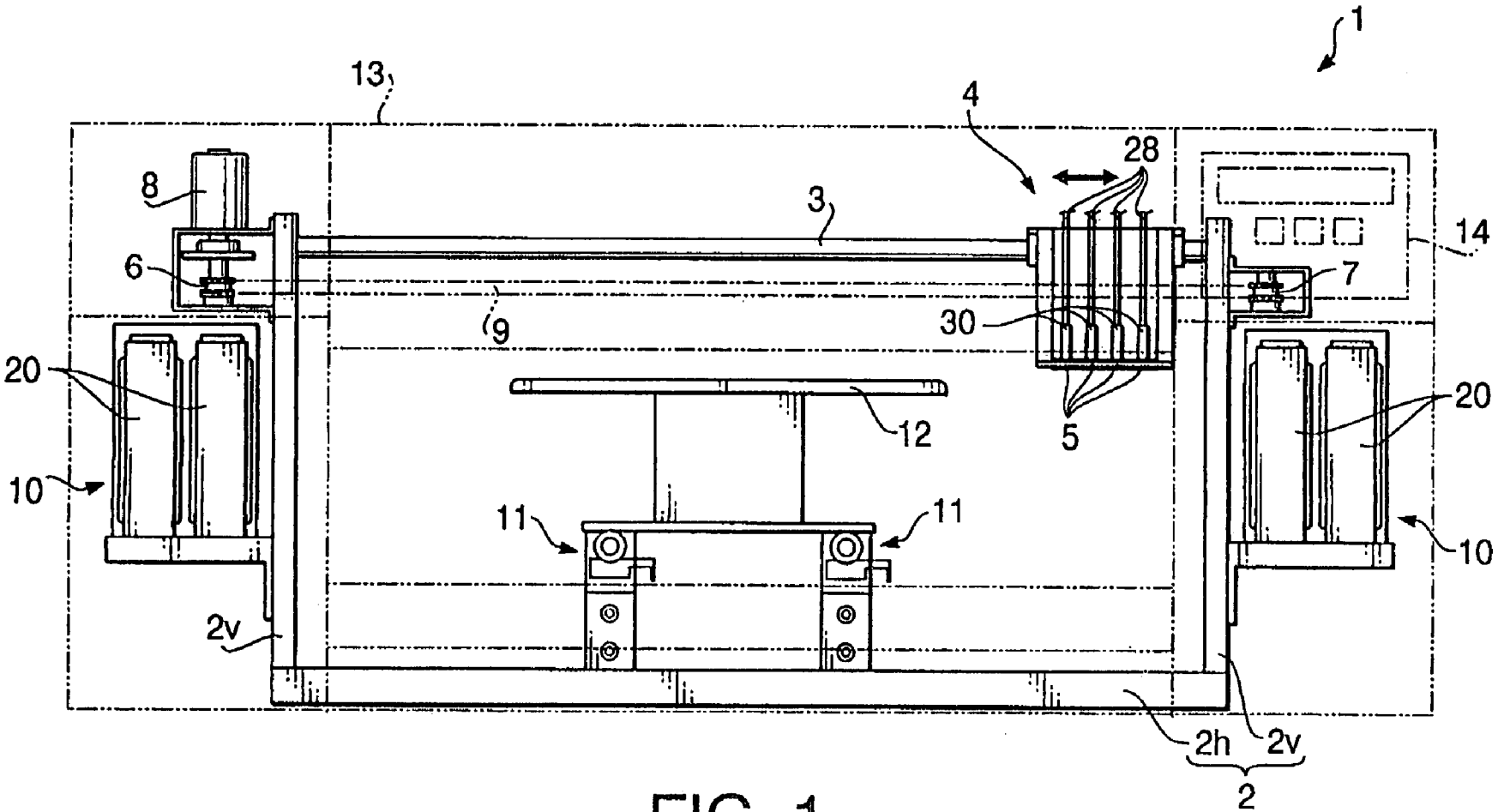

The present invention relates to an inkjet printer that ejects ink on a recording medium to print an image thereon.

Conventionally, a so-called serial type inkjet printer has been known. In the serial type inkjet printer, an inkjet head is mounted on a carriage that reciprocates in a direction perpendicular to a feeding direction of a recording sheet (i.e., in a width direction of the recording sheet). A tube is connected to the inkjet head for supplying ink from an ink supplying source to the inkjet head. When an image is printer using such a serial type inkjet head, when the carriage changes its moving direction, a large acceleration acts on the inkjet head and the ink inside the tube, which connects the inkjet head with the ink supplying source. The acceleration generates dynamic pressure in the ink within the tube.

Some inkjet head is provided with a sub-tank, which is also mounted on the carriage. When the sub-tank is provided, the ink inside the sub-tank is ruffled to be frothed. Then, the ink may entrains bubbles. Due to the dynamic pressure and/or entrained bubbles, the inkjet head may eject the ink unstably.

An example of a structure to overcome the problems mentioned above is disclosed in Japanese Patent Application Provisional Publication HEI 10-329330. The inkjet head disclosed in this publication employs a sub-tank having an ink chamber which is divided with a divider into a first ink room and a second ink room. The first ink room is in fluid communication with an ink cartridge through a tube, and a second ink room is in fluid communication with an inkjet head. An opening is formed on the divider at a lower end thereof to connect the first and second ink rooms. Further, on side walls of the first and second ink rooms, openings closed with air shielding elastic films are formed.

In the above-mentioned sub-tank, the variation of the pressure of the ink can be absorbed with the deformation of the elastic films, and while bubbles introduced into the first ink room will not flow into the second ink room.

However, in the inkjet printer disclosed in the above-described publication, the divider of the sub-tank is formed so that it extends parallel to the reciprocating direction of the carriage. Therefore, the divider cannot prevent the ink in the sub-tank from being ruffled by the reciprocating motion of the carriage. Therefore, the ink in the sub-tank (in the second ink room) may froth up and the bubbles entrained in the ink may flow from the second ink room into the inkjet head, which makes the ink ejection of the inkjet head unstable.

SUMMARY OF THE INVENTION

The present invention is advantageous in that an improved inkjet printer is provided, in which frothing of ink in a sub-tank due to ruffle of the ink can be suppressed.

An inkjet printer according to an aspect of the invention includes an inkjet head that ejects ink onto a recording medium, a movable ink tank having an ink introducing opening, an ink storing space for storing ink introduced through the ink introducing opening, and an ink discharging opening for discharging the ink of the ink storing space into the inkjet head, and a carriage that supports the inkjet head and the movable ink tank and reciprocates in a direction perpendicular to a feeding direction of the recording medium. The movable ink tank includes a partition wall which divides the ink storing space into multiple rooms arranged in a direction parallel with a reciprocating direction of the carriage which are in fluid communication with each other at upper portions thereof. The partition wall has a portion extending in a direction substantially perpendicular to the reciprocating direction of the carriage.

For example, the partition wall divides the ink storing space into a first ink room being in fluid communication with the ink introducing opening and a second ink room being in fluid communication with the ink discharging opening.

In the inkjet printer configured as above, the partition wall extending perpendicularly to the reciprocating direction can effectively prevent the ink in the ink storing space from being significantly agitated. Thus, the ink does not froth up in the movable ink tank and hence does not entrain bubbles thereinto. The bubbles may make the ink ejection property of the inkjet head unstable.

Optionally, the inkjet printer may include a stationary ink tank, and a tube that connects the movable ink tank with the stationary ink tank to supply ink of the stationary ink tank into the movable ink tank.

Optionally, the partition wall may consist of portions being perpendicular to the reciprocating direction of the carriage.

Further optionally, the ink introducing opening may be arranged so that the ink is introduced into the movable ink tank in parallel with the partition wall.

Optionally, at least a portion of a side wall of the movable ink tank is flexible. Alternatively or additionally, the partition wall may be flexible.

Further optionally, the flexible portion of the side wall of the movable ink tank faces the partition wall.

Optionally, one of the multiple rooms of the movable ink tank may be in fluid communication with the ink introducing opening. A side wall of this room may include a portion that faces the partition wall and is flexible.

Optionally, the ink introducing opening may be located lower than a top edge of the partition wall.

Optionally, the movable ink tank may include a divider plate protruding downward from a ceiling of the ink storing space, which divides an upper part of one of the multiple rooms defined in the ink storing space. The divider plate may be so arranged that a lower end of the divider plate is located lower than a top edge of the partition wall. Additionally, the divider plate may be formed such that a lower end portion of the divider plate and an upper end portion of the partition wall faces each other.

Alternatively, the movable ink tank may include multiple divider plates protruding downward from respective ceilings of the multiple rooms defined in the ink storing space.

Optionally, at least a part of at least one side of the movable ink tank is light transmissive. In some cases, the light transmissive part of the movable ink tank may be flexible. The inkjet printer may be further provided with an optical liquid level sensor for detecting the ink level within the movable ink tank through the light transmissive part of the movable ink tank.

Optionally, one of the multiple rooms of the movable ink tank is in fluid communication with the ink discharging opening and has a side wall of which portion facing the partition wall is light transmissive. In some cases, the light transmissive portion is flexible. Also in these cases, the inkjet printer may be provided with an optical liquid level sensor for detecting the ink level within the movable ink tank through the light transmissive portion.

According to another aspect of the invention, an ink tank to be connected to an inkjet head for supplying ink to and moving integrally with the inkjet head when the inkjet head reciprocates to print on an object is provided. The ink tank includes a first ink room that receives the ink from a stationary ink source and a second ink room that receives the ink from the first ink room and supplies the ink to the inkjet head. Both of the first and second ink rooms are formed narrower in a reciprocating direction of the inkjet head than in a direction perpendicular to the reciprocating direction.

Since the first and second ink rooms are formed narrow in the reciprocating direction, the ink stored in the first and second ink tank are not significantly agitated when the ink tank reciprocates integrally with the inkjet head. Thus, the ink does not entrain bubbles thereinto which may make the operation of the inkjet head unstable.

In particular cases, the first and second ink rooms are arranged in the reciprocating direction and separated from each other with a plate like wall formed perpendicular to the reciprocating direction. The plate like wall may have flexibility to absorb pressure fluctuation in the ink within the first and second ink rooms. For example, the plate like wall may be a flexible film.

An opening may be formed above the plate like wall so that the ink in the first ink room can flow into the second ink room over the plate like wall.

In some cases, at least a part of a side wall of the first ink room facing the plate like wall has flexibility to absorb pressure fluctuation in the ink within the first ink room. This flexible part of the side wall of the first ink room may be a flexible film. Further, this film may be a light transmissive film.

In some cases, at least a part of a side wall of the second ink room facing the plate like wall is light transmissive. This light transmissive part may be a light transmissive film. Further, this film may be a flexible film.

The ink tank may further include an ink introducing channel for introducing the ink from the stationary ink source into a lower part of the first ink room. This lower part of the first ink room may include an expanded portion that expands in a direction perpendicular to the reciprocating direction. The ink introducing channel may be arranged such that the ink is introduced into the first ink room vertically downward.

When the first and second ink rooms are arranged in the reciprocating direction and separated from each other with a plate like wall formed perpendicular to the reciprocating direction, the ink introducing channel introduces the ink into the first ink room in parallel with the reciprocating direction.

The ink tank may include an ink discharging opening formed on a bottom of the second ink room for discharging the ink into the inkjet head.

The ink tank may include a divider that divides a surface of the ink in one of the first and second ink rooms into smaller areas, for example, in substantially halves. Preferably, the divider divides the surface of the ink in the reciprocating direction. The divider may be a plate extending perpendicularly to the reciprocating direction. The plate may protrude downward from a ceiling of one of the first and second ink rooms.

According to a further aspect of the invention, there is provided an ink tank connected with an inkjet head to supply ink to an inkjet head, the ink tank and the inkjet head being mounted on a movable carriage which is reciprocally movable along a horizontal direction. The ink tank includes an ink room that reserve the ink to be supplied to the inkjet head, and a dividing member that divides at least a portion about a surface of the ink reserved in the ink room into a plurality of sections arranged in a movable direction of the carriage.

BRIEF DESCRIPTION OF THE ACCOMPANYING DRAWINGS

Figure 2:
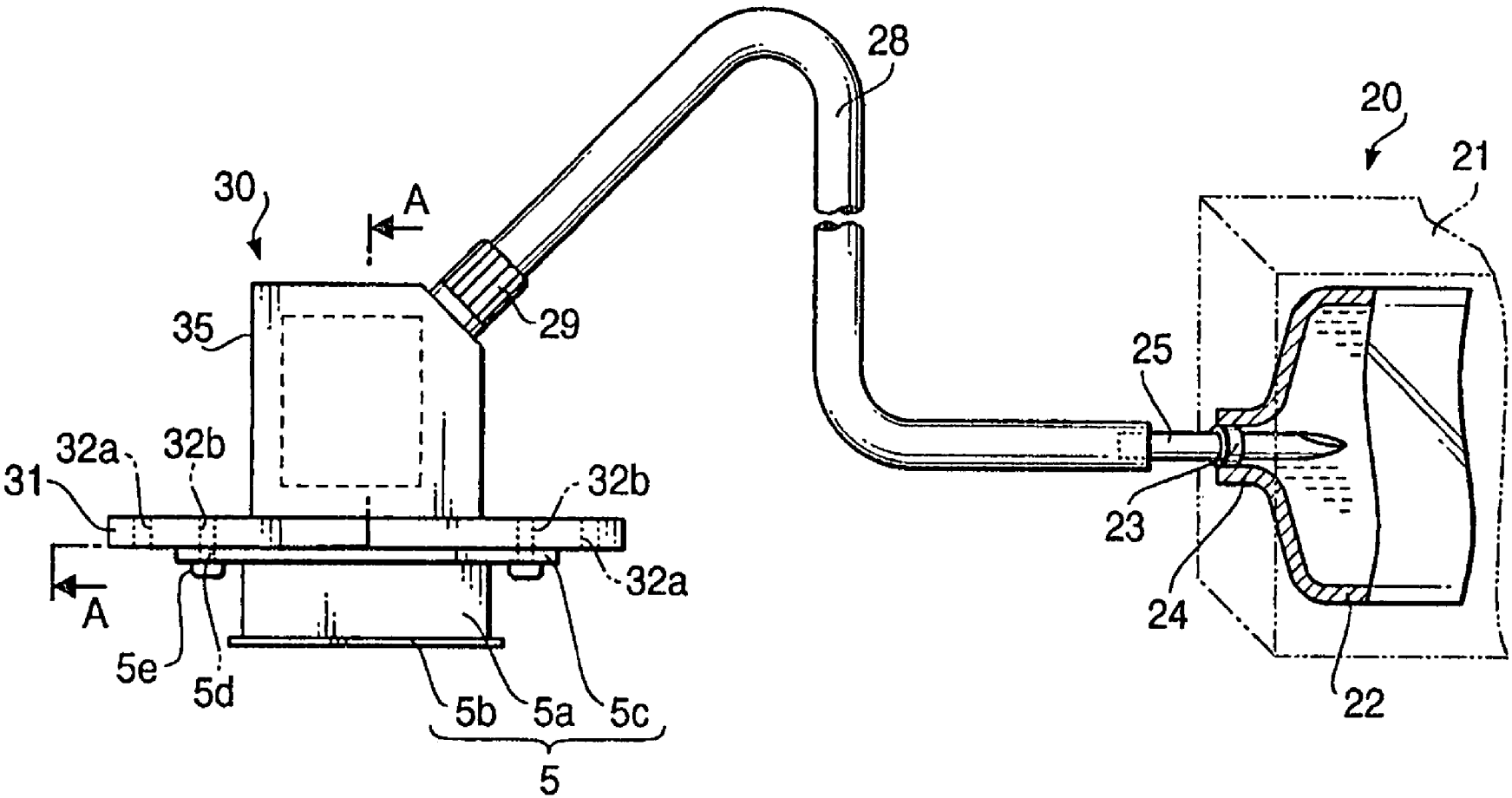
Figure 3A:
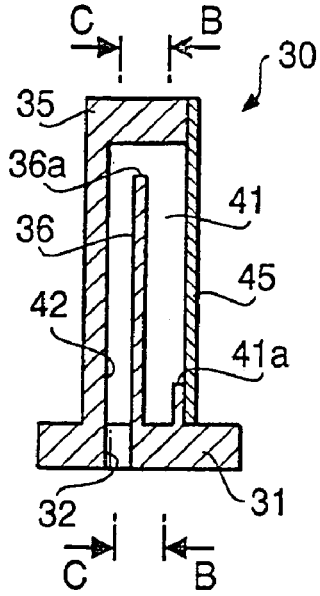
Figure 3B:
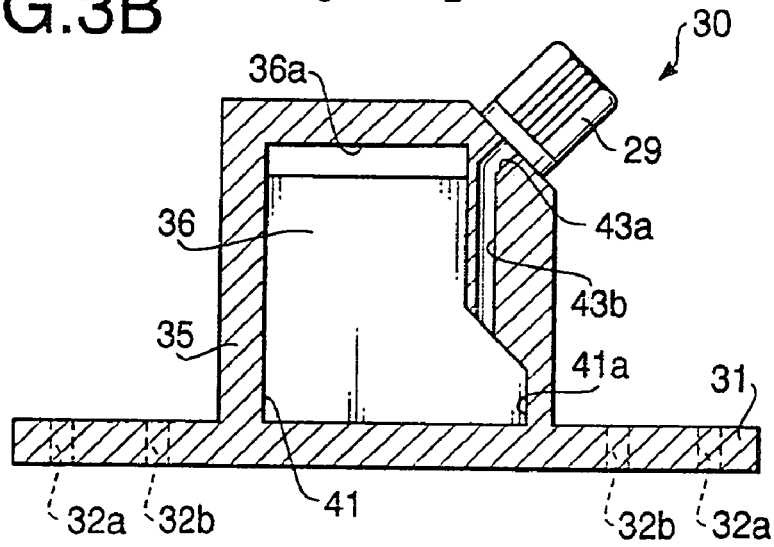
Figure 3C:
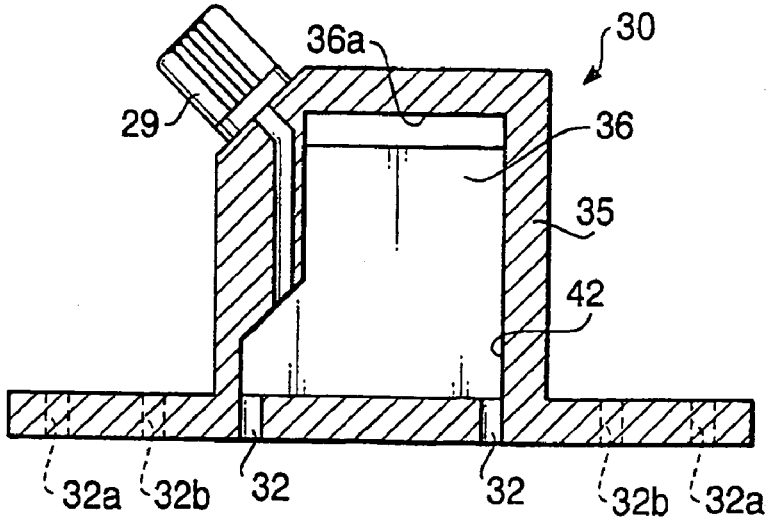
Figure 4A:
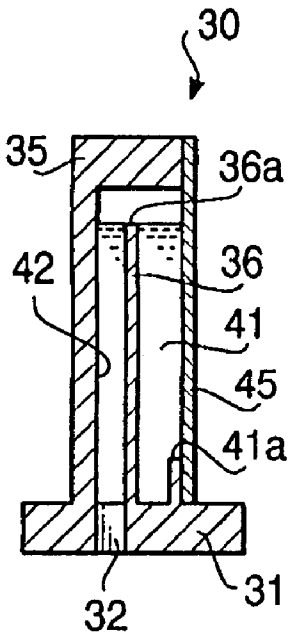
Figure 4B:
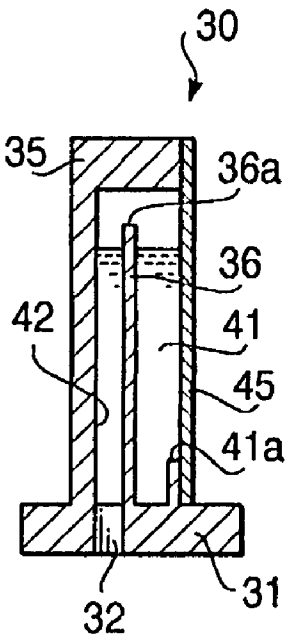
Figure 4C:
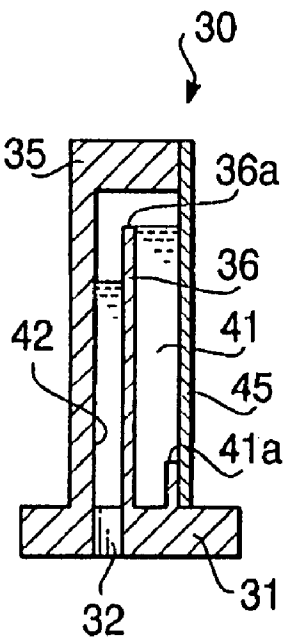
Figure 4D:
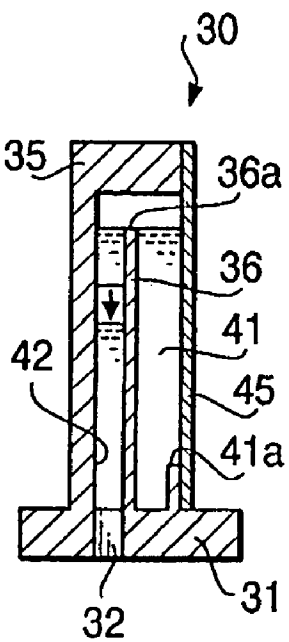
Figure 5:
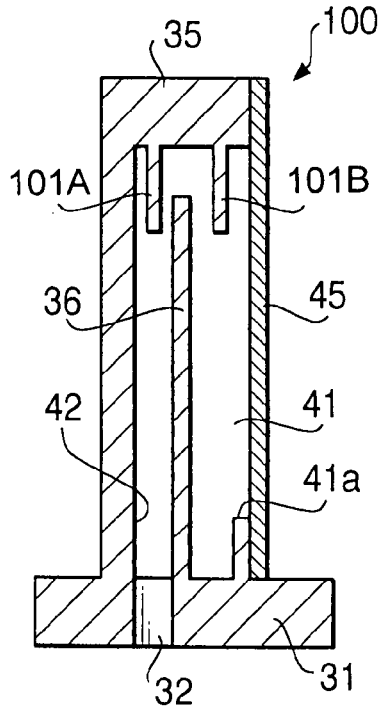
Figure 6:
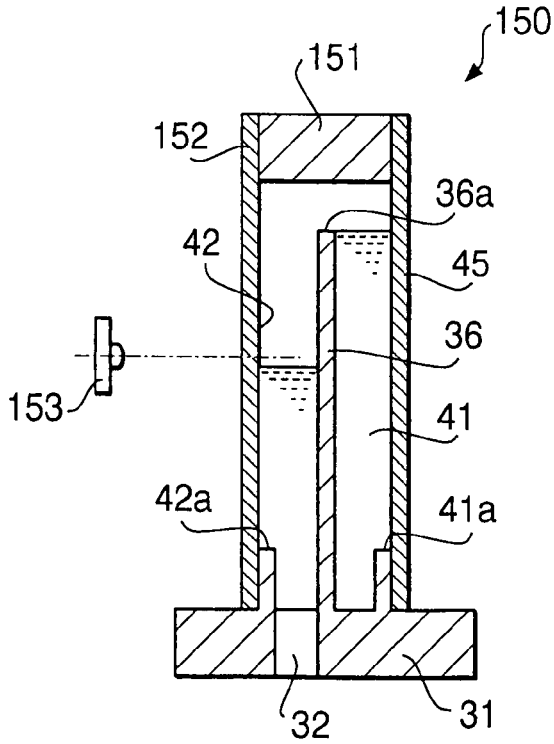

FIG. 1 schematically illustrates a configuration of an inkjet printer according to an embodiment of the invention;

FIG. 2 schematically illustrate a configuration for supplying ink to inkjet heads of the inkjet printer shown in FIG. 1;

FIGS. 3A through 3C schematically show a configuration of a sub-tank of the inkjet printer shown in FIG. 1;

FIGS. 4A through 4D schematically illustrate states of ink within the sub-tank shown in FIGS. 3A through 3C; and FIGS. 5 through 7 show variations of the sub-tank shown in FIGS. 3A through 3C.

DETAILED DESCRIPTION OF THE EMBODIMENTS

Hereinafter, an embodiment of the present invention will be described with reference to the accompanying drawings.

Configuration of the Printer

FIG. 1 schematically illustrates a configuration of an inkjet printer 1 according to an embodiment of the invention. As shown in FIG. 1, the inkjet printer 1 includes a frame 2 provided on a casing (which is schematically illustrated by chain double-dashed lines). The frame 2 includes a horizontal portion 2*h* disposed on the bottom of the inkjet printer 1 and vertical portions 2*v* extending perpendicularly to and upward from both sides of the horizontal portion 2*h*.

A slide rail 3 is horizontally supported by the vertical portions 2*v* to extend between the upper ends of the vertical portions 2*v*. A carriage 4 is mounted on the slide rail 3 slidably in a longitudinal direction of the slide rail 3, or a main scanning direction of the inkjet printer 1. Four piezoelectric inkjet heads 5 are mounted on an undersurface of the carriage 4. Each inkjet head 5 corresponds to an ink of different color.

The vertical portions 2*v* support a pair of pulleys 6, 7 at the upper portions thereof. One of the pulleys, the pulley 6, is coupled to a spindle of a motor 8 supported by one of the vertical portions 2*v*. An endless belt 9 is wound around the pulleys 6 and 7. The carriage 4 is coupled with this endless belt 9.

In the inkjet printer 1 arranged as above, the carriage 4 reciprocates linearly along the slide rail 3 as the motor 8 rotates the pulley 6 in normal and reverse directions. As a result, the inkjet heads 5 move back and forth in the main scanning direction.

Each vertical portion 2*v* is provided with a pair of mounting portions 10, on which ink tanks (stationary ink tanks) 20 are detachably mounted. Each mounting portion 10 is arranged to hold two ink tanks 20 containing inks of different colors. Each ink tank 20 includes an ink bag 22 (see FIG. 2). The ink bags 22 of the ink tanks 20 are connected, by flexible tubes 28, to respective ones of the four sub-tanks (movable ink tanks) 30 disposed above respective inkjet heads 5. The sub-tanks 30 are in fluid communication with respective inkjet heads 5, as will be describe later. Thus, ink can be supplied from the ink tanks 20 to the inkjet heads 5 through the sub-tanks 30.

As shown in FIG. 1, a slide mechanism 11 is provided on the horizontal portion 2*h* of the frame 2. The slide mechanism 11 supports a platen 12 thereon. The platen 12 is arranged so that a recording medium, such as a cloth, a plastic sheet, a paper, or the like, is placed thereon with a side on which an image is printer facing the ink jet heads 5.

The inkjet printer 1 further includes a platen moving mechanism (not shown) for reciprocating the platen 12 in a direction perpendicular to a plane of FIG. 1 (i.e., in a direction perpendicular to the main scanning direction, i.e., an auxiliary scanning direction). Although the platen moving mechanism is not shown, it should be noted that it may include a rack and pinion mechanism, an endless belt, or the like for driving the platen 12.

The inkjet printer 1 has a cover 13 for covering and thereby protecting the inkjet heads 5, the slide mechanism 11, and the like. Note that the cover 13 is illustrated by chain double-dashed lines, or imaginary lines, so that the structure inside the cover 13 can be shown in detail. A front side of the cover 13 is provided with an operation panel 14, which includes a liquid crystal display and multiple operation buttons, at an upper part of a right-hand side in FIG. 1.

Configuration for Supplying Ink to Inkjet Head

FIG. 2 schematically illustrates a configuration for supplying ink to the inkjet head 5. As shown in FIG. 2, the sub-tank 30 for storing the ink supplied from the ink tank 20 is disposed above the inkjet head 5. A connection portion 29 is formed on an upper portion of the right-hand side of the sub-tank 30 in FIG. 2. The connection portion 29 is connected with one end of the flexible tube 28. The other end of the flexible tube 28 is provided with a hollow needle 25 penetrating a cap 23 of the ink tank 20, which will be described later. With this structure, the ink of the ink tank 20 flows into the flexible tube 28 through the hollow needle 25.

By connecting the ink tank 20 and the sub-tank 30 with the flexible tube 28 as described above, the ink of the ink tank can be supplied to the sub-tank 30 while disposing the ink tank at a place where the ink tank can be exchanged with ease. Thus, in the present embodiment, the ink tank 20 can be exchanged easily when the ink tank 20 is empty.

The ink tank 20 has a housing 21 made of synthetic resin. The ink bag 22 is provided in the housing 21 and contains degassed ink. The ink bag 22 has a spout 24, which is closed by the cap 23 made of silicon rubber or Butyl-rubber. The ink bag 22 is made of a pouched film obtained by bonding multiple flexible films by thermo compression. The pouched film has a laminated structure of a polyethylene resin layer, a polyester layer, an aluminum foil layer and a nylon layer, laminated in this order. The polyethylene resin layer serves as an inner most layer of the ink bag 22. The polyester layer serves as a base material layer. The aluminum foil layer is provided on the outer side of the polyester layer and serves as a gas barrier layer. The nylon layer, the outer most layer of the ink bag 22, is provided in order to enhance the strength of the pouched film.

As previously described, the hollow needle 25, provided on one end of the flexible tube 28, penetrates the cap 23. When the ink of the ink tank 20 is all consumed, the hollow needle 25 can be pulled off from the cap 23 and the ink tank 20 is exchanged with a new one.

The four inkjet heads 5 correspond to four colors (i.e., magenta, yellow, cyan, and black), respectively, and are arranged on the carriage 4, as shown in FIG. 1, along the direction in which the carriage 4 reciprocates. Further, the inkjet heads 5 are connected with respective ink tanks 20 through the flexible tubes 28 and the sub-tanks 30.

Each inkjet head 5 has an elongated rectangular shape when observed from above and is disposed so that a longitudinal direction thereof is perpendicular to the direction in which the carriage 4 reciprocates.

As shown in FIG. 2, each inkjet head 5 has a head body 5*a*, which includes a flow channel unit (in which ink flow channels and pressure chambers are formed) and an actuator bonded onto the flow channel unit to pressurize the ink within the pressure chambers. The bottom of the head body 5*a* is formed with a plurality of minute diameter ink ejecting nozzles for ejecting ink downward.

A cover 5*b* is provided on the bottom of the head body 5*a*, which prevents the ink ejecting nozzles from coming into contact with the recording medium during printing. The cover 5*b* is a plate formed with a rectangular opening so that the cover 5*b* does not hinder ejection of ink from the head body 5*a*.

A mounting plate 5*c* is provided on the top surface of the head body 5*a*. Through holes 5*d* are formed at both side portions of the mounting plate 5*c* so that the mounting plate 5*c*, or the inkjet head 5, can be fixed on the bottom of the sub-tank 30 by screws 5*e*.

The inkjet heads 5 are supported by the carriage 4 such that a small gap is formed between the undersurface of the inkjet head 5 and the top surface of the platen 12 when the inkjet heads 5 are located above the platen 12. The gap allows the recording medium to be placed on the platen 12 so as not to contact the inkjet heads 5 traveling across the platen 12. The recording medium is set on the platen such that a portion thereof on which an image is printed is placed on the top surface of the platen 12. The inkjet heads 5 are driven to reciprocally move across the platen 12 by the carriage 4 and eject ink onto the recording medium. Each inkjet head 5 ejects ink of different color so that a desired color image can be printed on the recording medium.

FIGS. 3A through 3C schematically show a configuration of the sub-tank 30. FIG. 3A is a sectional view of the sub-tank 30 taken along a line A-A in FIG. 2. FIGS. 3B and 3C are sectional views of the sub-tank 30 taken along lines B-B and C-C in FIG. 3A, respectively.

The sub-tank 30 has a base plate 31 for fixing the sub-tank 30 on the carriage 4 and a body 35 formed into a substantially rectangular parallelepiped shape. The body 35 has an ink storing space (41, 42) therein for storing the ink supplied from the ink tank 20.

The base plate 31 has an elongated rectangular shape when observed from above. The sub-tank 30 is disposed on the carriage 4 such that a longitudinal direction of the base plate 31 is perpendicular to the reciprocating direction of the carriage 4. The base plate 31 is formed with through holes 32*a*, which allow the base plate 31 to be fixed on the carriage 4 by screws, and through holes 32*b* provided with screw threads on inner surfaces thereof. The screws 5*e* shown in FIG. 2 are screwed into the through holes 32*b* to fix the inkjet head 5 to the sub-tank 30.

As shown in FIG. 3A, a wall 36 is formed inside the body 35 to divide the ink storing space of the body 35 into a first ink room 41 and a second ink room 42. The wall 36 extends upward from the base plate 31 perpendicularly to the moving direction of the carriage 4. The wall 36 is formed lower than the height of the ink storing space (41, 42) so that an opening 36*a* is formed above the wall 36. The opening 36*a* allows the first and second ink rooms 41 and 42 to be in fluid communication with each other.

A side wall of the first ink room 41 is formed with an opening 41*a*, which has substantially the same size as the wall 36 and is formed to face the wall 36. The opening 41*a* is covered, or closed, by a flexible film (flexible member) 45. The flexible film 45 is a two layer film, which is configured such that a polyethylene terephthalate resin layer and polypropylene resin layer are laminated. The polypropylene resin layer is 30 μm thick. The polyethylene terephthalate resin layer is 10 μm thick. Silicon dioxide is deposited on a side of the polyethylene terephthalate resin layer. The silicon dioxide layer formed on the polyethylene terephthalate resin layer serves as an air shielding layer that prevents air and vapor from entering the sub-tank 30 through the flexible film 45.

It should be noted that the body 35 of the sub-tank 30 is made of polypropylene resin. The flexible film 45 is disposed such that the polypropylene resin layer faces the body 35 and fixed on the side of the body 35 by thermo compressing. Since the material of the body 35 and the material of the layer of the flexible film 45 facing the body 35 are the same, a large bonding force between the body 35 and the flexible film 45 can be obtained.

When the body 35 is made of polyethylene resin, it is preferable that the layer of the flexible film 45 facing the body 35 is also made of polyethylene resin, i.e. the same material as the body 35. With such a configuration, the bonding force between the body 35 and the flexible film 45 can be enhanced.

As shown in FIG. 3B, the sub-tank 30 has an ink introducing channel 43 that connects the connection portion 29 and a lower part of the first ink room 41. When the connection portion 29 is connected with the flexible tube 28, the ink introducing channel 43 is in fluid communication with the flexible tube 28. The ink introducing channel 43 is bent near the connection portion 29 to form an inclined portion 43*a* extending toward the connection portion 29 and a vertical portion 43*b* extending vertically downward. The lower end of the vertical portion 43*b* is in fluid communication with the first ink room 41 at a position lower than the upper edge of the wall 36. The ink introducing channel 43 is formed parallel to the wall 36.

As shown in FIG. 3C, two ink discharging openings 32 for discharging the ink stored in the second ink room 42 into the inkjet head 5 are formed on the base plate 31. The ink discharging openings 32 are formed at locations corresponding to ink supply openings (not shown) of the inkjet head.

As shown in FIGS. 3B and 3C, the first and second ink rooms 41 and 42 are formed so that the cross sections thereof have substantially the same shape. The first ink room 41 has an expanded portion 41*a* at the lower part thereof. The expanded portion 41*a* is formed below the ink introducing channel 43 so that the ink introducing channel 43 is in fluid communication with the first ink room 41 at the expanded portion 41*a*. The second ink room 42 also has an expanded portion 42*a* at a location corresponding to the expanded portion 41*a* of the first ink room 41. The expanded portions 41*a* and 42*a* of the first and second ink rooms 41 and 42 increase the amount of ink that can be stored in the first and second ink rooms 41 and 42. In addition to the above, the expanded portion 42*a* of the second ink room 42 allows the distance between the two ink discharging openings 32 to be increased so that the ink can be introduced into the inkjet head 5 from locations defined near both ends of the inkjet head 5 in the longitudinal direction thereof.

State of the Ink within the Sub-Tank

Hereinafter, the state of the ink within the sub-tank 30 will be described. FIGS. 4A through 4D schematically illustrates states of the ink within the sub-tank 30. FIG. 4A illustrates the state of the ink initially introduced into the sub-tank 30. FIG. 4B illustrates increase of air within the sub-tank 30 due to introduction of ink including bubbles. FIG. 4C illustrates the state of the ink within the sub-tank 30 after printing or purging is carried out with the sub-tank 30 being in the state shown in FIG. 4B. FIG. 4D illustrates the state of the ink within the sub-tank 30 after purging is further carried out with the sub-tank 30 being in the state shown in FIG. 4C.

When the ink tank 20 is to be exchanged, the hollow needle 25 on one end of the flexible tube 28 is pulled off from the empty ink tank 20 and then inserted into a new ink tank 20. Since the hollow needle 25 is once pulled off from the ink tank 20, air enters into the flexible tube 28 through the hollow needle 25. The air moves through the flexible tube 28 and enters the sub-tank 30 as the ink of the new ink tank 20 is initially introduced into the sub-tank 30. The air is introduced into the sub-tank 30 accumulated at the upper parts of the first and second ink rooms 41 and 42 as shown in FIG. 4A. The volume of the air within the sub-tank 30 is adjusted, by the purging carried out when the ink is initially introduced into the sub-tank 30 from the new ink tank 20, so that the ink levels in the first and second ink rooms substantially coincides with the top surface of the wall 36.

The air accumulated at the upper parts of the first and second ink rooms 41 and 42 serves as an air damper. That is, when an appropriate volume of air is accumulated at the upper parts of the first and second ink rooms, this air can absorb the dynamic pressure generated in the ink within the flexible tube 28 as the carriage reciprocates for printing. As a result, the effect of the dynamic pressure of the ink within the flexible tube 28 on the ink ejection of the inkjet head 5 is reduced and the ink ejection property of the inkjet head 5 becomes stable.

Under normal conditions, the ink level within the sub-tank 30 is maintained at that shown in FIG. 4A while the inkjet head 5 ejects ink to print an image on a recording medium. When ink is ejected from the inkjet head 5, negative pressure is generated within the ink channel formed in the inkjet head 5. Due to this negative pressure, the ink of the second ink room 42 of the sub-tank 30 flows into the inkjet head 5 through the ink discharging openings 32 and the ink of the first ink room 41 flows over the wall 36 into the first ink room 41. Further, the ink in the flexible tube 28 flows into the first ink room 41 through the ink introducing channel 43 and the ink of the ink tank 20 flows into the flexible tube 28. In this way, the ink of the ink tank 20 is supplied to the inkjet head 5 by the negative pressure generated in the inkjet head 5. It should be noted that the negative pressure generated in the inkjet head 5 due to the ejection of the ink is not so large. Therefore, the ink level in the sub-tank 30 is kept at the state illustrated in FIG. 4A.

When the ink introduced into the sub-tank 30 from the ink tank 20 through the flexible tube 28 includes bubbles, the volume of the air accumulated in the sub-tank 30 increases and causes the ink level within the sub-tank 30 to be pressed down as shown in FIG. 4B. When the inkjet head 5 ejects ink for printing or purging although the ink level is pressed down as shown in FIG. 4B, the ink level in the second ink room 42 comes down since the ink flows into the inkjet head 5 through the ink discharging openings 32, while the ink level in the first ink room 41 raises up to substantially the same height of the wall 36. As a result, the head between the ink in the first ink room 41 and the ink in the second ink room 42 becomes significantly large. This large head prevents the ink in the first ink room 41 from coming over the wall 36 by the small negative pressure generated in the ink channel of the inkjet head 5 during printing, and make the inkjet head 5 inoperative.

The excessive volume of the air within the sub-tank 30 can be reduced to the normal volume by carrying out the purging of the inkjet head 5. The purging generates a large negative pressure in the ink channel of the inkjet head 5. Thus, the ink level in the second ink room 42 comes further down and the ink in the first ink room 41 flow into the second ink room 42 as shown in FIG. 4D. When the ink flows into the second ink room 42, the excess air within the sub-tank 30 is trapped between the ink in the second ink room 42 and the ink that has flown into the second ink room 42 as shown in FIG. 4D. This excess air is then discharged from the sub-tank 30 through the inkjet head 5, by further carrying out the purging of the inkjet head 5.

It should be noted that the configuration of the sub-tank 30 is not limited to that described above. Hereinafter, variations of the sub-tank 30 will be described with reference to FIGS. 5 and 6 and FIGS. 7A through 7C, in which elements that are substantially the same as those described in FIGS. 1 through 4 are denoted by the same reference number.

FIG. 5 shows a sectional view of a sub-tank 100, which is a first variation of the sub-tank 30. The sub-tank 100 has the same configuration as the sub-tank 30 except that it is further provided with two partition walls 101A and 101B.

The partition walls 101A and 101B are formed on an upper wall (ceiling) of the sub-tank 100 so that they protrude downward from and an perpendicular to that upper wall. Further, the partition walls 101A and 101B are formed to extend parallel to the wall 36 and have substantially the same size as the wall 36 in the direction perpendicular to the sheet of FIG. 5. The lower end portions of the partition walls 101A and 101B are facing the upper end portion of the wall 36. The partition wall 101A is located at the center of the first ink room 41 in the direction in which the sub-tank 100 reciprocates (in the right and left direction in FIG. 5) as to divide the upper end portion of the first ink room 41 into halves. The partition wall 101B is located at the center of the second ink room 42 in the right and left direction in FIG. 5 to divide the upper end portion of the second ink room 42 into halves.

In the sub-tank 100 configured as above, the lower end portions of the partition walls 101A and 101B are located in the ink when the ink level in the first and second ink rooms 41 and 42 are equal to the top surface of the wall 36. Thus, the lower end portions of the partition walls 101A and 101B absorb the ruffles on the surface of the ink in the first and second ink rooms 41 and 42 generated by the reciprocating motion of the carriage 4, and thereby prevents bubbles to be mixed into the ink.

As previously described, the lower end portions of the partition walls 101A and 101B are parallel with the wall 36. In other words, the partition walls 101A and 101B are substantially perpendicular to the direction of the reciprocating motion of the carriage 4. Thus, the partition walls 101A and 101B can effectively absorb the ruffles of the ink in the sub-tank 100 generated by the reciprocating motion of the carriage 4.

Further, since the partition walls 101A and 101B divide the upper end portions of the first and second ink rooms 41 and 42 in halves in the direction of the reciprocating motion of the carriage 4, the width of the surface of the ink in each of the first and second ink rooms 41 and 42 is less than that of the sub-tank 30 shown in FIGS. 3A through 3C. Thus, the tendency to ruffle is further suppressed.

FIG. 6 shows a sectional view of a sub-tank 150, which is a second variation of the sub-tank 30. The sub-tank 150 has the same configuration as the sub-tank 30 except that an opening 42*a* is formed on a side wall of the second ink room 42 facing the wall 36 and that a film 152 is provided on the side wall to close that opening 42*a*.

The film 152 is a two-layer laminate made of substantially the same material as the flexible film 45. Preferably, according to this example, the film 45 may be a light transmissive (translucent or transparent) film.

The sub-tank 150 is further provided with a photo-sensor (ink level sensor) 153 disposed beside film 152. The photo-sensor 153 detects the ink at substantially the middle portion of the second ink room 42.

As above, since the film 152 is light transmissive, the ink level in the second ink room 42, or the volume of the ink remaining in the second ink room 42 can be detected by the photo-sensor 153. Since the ink level in the second ink room 42 comes down when bubbles (ink containing bubbles) are introduced into the sub-tank 150 as previously described with reference to FIGS. 4B and 4C, the photo-sensor 153 can also detect the increase of the air volume in the sub-tank 150 due to those bubbles. Therefore, it is possible to determine and inform the user the timing of the purging of the inkjet head 5 for discharging the excess air in the sub-tank 150 based on the output of the photo-sensor 153.

Further, since the film 152 has flexibility, the film 152 can absorb the dynamic pressure that is generated in the ink in the flexible tube 28 as the carriage 4 reciprocates. Thus, the ink ejection property of the inkjet head 5 can be kept stable, and hence the printing quality can be kept high.

It should be noted that also the flexible film 45 of the first ink room 41 may be replaced with a light transmissive film so that the volume of the ink remaining in the first ink room 41 can be detected by an photo-sensor.

Figure 7A:
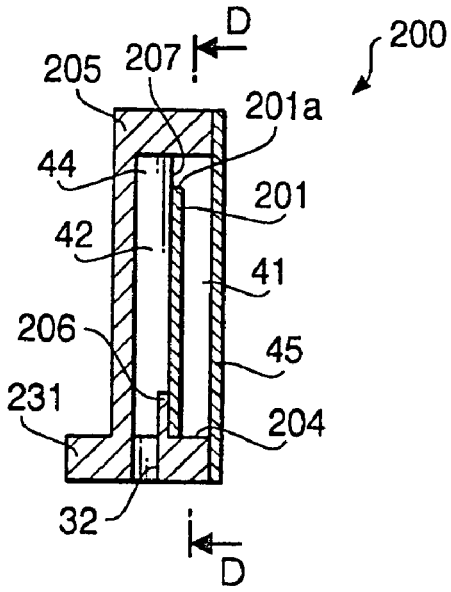
Figure 7B:
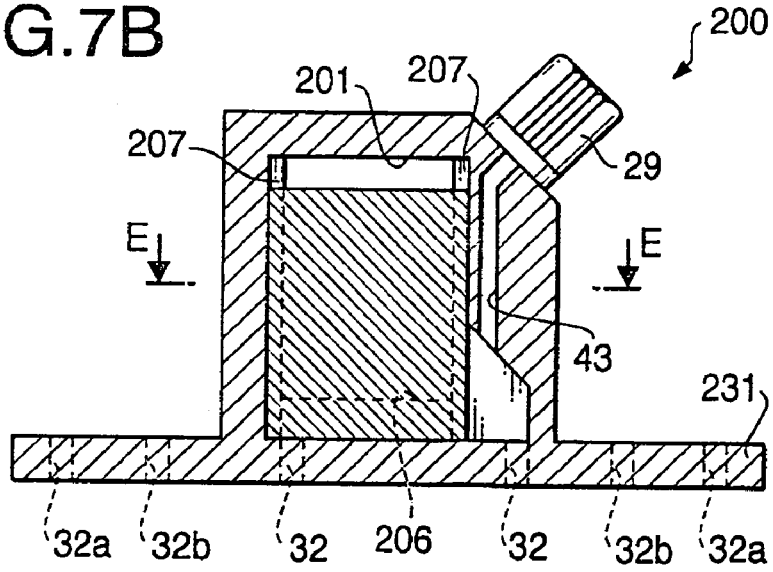
Figure 7C:
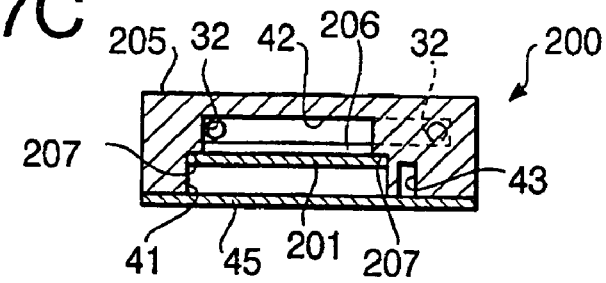

FIG. 7A shows a sectional view of a sub-tank 200, which is a third variation of the sub-tank 30. FIGS. 7B and 7C show sectional views of the sub-tank 200 shown in FIG. 7A taken along lines D-D and E-E, respectively.

The sub-tank 200 includes a base plate 231, which is to be fixed on the carriage 4, and a body portion 205 formed on the base plate 231. The body portion 205 is substantially a rectangular parallelepiped within which an ink storing space 44 is defined. As with the base plate 31 of the sub-tank 30 shown in FIGS. 3A through 3C, the base plate 231 is formed with ink discharging openings 32 and through holes 32*a* and 32*b*.

The base plate 231 has an plate like extended portion 206 on an upper surface thereof. The extended portion 206 extends upward from the upper surface of the base plate 231 and is perpendicular to the direction in which the carriage 4 reciprocates.

As shown in FIGS. 7B and 7C, vertically extending stepped portions 207 are formed on the inner wall of the body portion 205 at ends of the extended portion 206 in the longitudinal directions thereof (in the horizontal direction in FIG. 7B).

A flexible film 201 is fixed on a side of the extended portion 206 as well as on the stepped portion 207. The flexible film 201 is perpendicular to the direction of the reciprocating motion of the carriage 4 and serves as a wall similar to the wall 36 of the sub-tank 30 shown in FIGS. 3A through 3C. That is, the flexible film (wall) 201 divides the ink storing space 44 of the sub-tank 200 into substantially equal halves, or in the first and second ink rooms 41 and 42. The length of the flexible film (wall) 201 in the vertical direction is less than the height of the ink storing space 44 so that an opening 201*a* is defined above the flexible film (wall) 201 through which the upper portions of the first and second ink rooms 41 and 42 are in fluid communication with each other.

The flexible film 201 may have the same configuration as the flexible film 45. Alternatively, the flexile film 201 may be made of the same material as the body portion 205 to prevent drop of the bonding force between the body portion 205 and the flexible film 201 fixed thereon by thermo compression.

As with the sub-tank 30, the sub-tank 200 is provided with the connection portion 29 and the ink introducing channel 43 that connects the connection portion 29 and the first ink room 41 (see FIG. 7B). An opening 204, which is similar to the opening 41*a* of the sub-tank 30, is formed on a side of the first ink room 41. The flexible film 45 is attached on the sub-tank 200 so that it closes the sides of both of the first ink room 41 and the ink introducing channel 43. Note that, the ink introducing channel 43 extends parallel to the flexible film (wall) 201 as well as with the flexible film 45.

In the sub-tank 200 arranged as described above, since the wall 201 is formed with the flexible film, it is possible to integrally form the body portion 205 and the base plate 231 of the sub-tank 200. That is, the sub-tank 30 shown in FIG. 3A consists of a plurality of (e.g., three) parts other than the flexible film 45. Therefore, an assembling process is relatively troublesome since the three parts are adhered with each other. The sub-tank 200 can be formed as a single part to which the flexible films 201 and 45 are adhered. That is, by employing the structure of the sub-tank 200 shown in FIG. 7A, the number of parts can be reduced. Further, adhering the films 45 and 200 to the single part is relatively easy. Thus, the manufacturing cost can be reduced by employing the sub-tank 200.

In the sub-tanks 30, 100, 150, and 200 described above, since the wall (36, 201) is provided substantially perpendicularly to the reciprocating direction of the carriage 4, the frothing of the ink due to the reciprocating motion of the carriage 4 can be reduced compared to a conventional sub-tank in which the wall for dividing the inner space of the sub-tank is formed in parallel with the reciprocating direction of the carriage 4. Thus, the amount of bubbles entrained into the ink within the sub-tanks (30, 100, 150, 200) can be reduced. As a result, the ink ejection property of the inkjet head 5 becomes stable, and the printing quality is improved.

The walls (36, 201) in the sub-tanks (30, 100, 150, 200) described above also reduce the width (in the reciprocating direction of the carriage 4) of the multiple rooms (i.e., the first and second ink rooms 41 and 42) defined in the ink storing space of the sub-tanks (30, 100, 150, 200). The narrow with rooms reduce the frothing of the ink within the sub-tanks (30, 100, 150, 200).

In the sub-tanks (30, 100, 150, 200) according to the embodiments of the invention, the ink introducing channels 43 are defined in parallel with the walls (36, 201) dividing the ink storing space into the first and second ink rooms 41 and 42. Thus, the ink provided from the ink bag 20 flows into the sub-tanks (30, 100, 150, 200) in parallel with the walls (36, 201) and hence does not generates large ruffles in the ink stored in the sub-tanks (30, 100, 150, 200). In particular, since the outlet of the ink introducing channel 43 is located in the lower part of the sub-tanks (30, 100, 150, 200), the ink introduced into the sub-tanks (30, 100, 150, 200) through the ink introducing channels 43 does not generates ruffles on the ink surface. The ruffles cause bubbles which will be entrained into the ink.

Further, since the flexible films 45 provided on the sub-tanks (30, 100, 150, 200) absorb the dynamic pressure of the ink generated in the flexible tube 28 by the reciprocating motion of the carriage 4, the ink ejection of the inkjet head 5 is not affected by the dynamic pressure mentioned above. Therefore, the ink ejection property of the inkjet head 5 is kept at a substantially constant state, and hence high quality printing can be maintained.

The flexible film 45 is provided on the sub-tank (30, 100, 150, 200) to close the opening 41*a* formed on the side of the sub-tank (30, 100, 150, 200). Since the opening 41*a* has a similar size to the wall (36, 201) dividing the ink storing space, the flexible film 45 faces almost the whole area of the wall (36, 201). Thus, the flexible film 45 can effectively absorb the dynamic pressure of the ink being between the flexible film 45 and the wall (36, 201) and hence the dynamic pressure of the ink in the flexible tube 28.

Further, since the flexible film 45 is provided on the side surface of the first ink room 41, which is in fluid communication with the ink introducing channel 43, almost all of the dynamic pressure of the ink generated in the flexible tube 28 is absorbed in the first ink room 41 and does not transmit to the second ink room 42, which is in fluid communication with the inkjet head 5.

Further, since the sub-tanks (30, 100, 150, 200) has a simple configuration, of which ink storing space is divided in only two rooms, i.e., the first and second ink rooms 41 and 42, the sub-tanks can be produced in low cost.

While the invention has been described in detail with reference to specific embodiments thereof, it would be apparent to those skilled in the art that various changes and modifications may be made therein without departing from the spirit of the invention, the scope of which is defined by the attached claims.

For example, the wall (36, 201) dividing the ink storing space of the sub-tank (30, 100, 150, 200) into the first and second ink rooms 41 and 42 should include at least a portion that extends substantially perpendicularly to the reciprocating direction of the carriage 4, but it is not necessary to form the whole wall (36, 201) perpendicularly to the reciprocating direction of the carriage 4.

The flexible film 45 of the sub-tank (30, 100, 150, 200) is not essential and the sub-tank can be provided without forming an opening on the side of the first ink room 41 and attaching the flexible film 45 on the same side to close the opening.

The ink storing space of the sub-tank (30, 100, 150, 200) may be divided not only into two ink rooms but also into more than two rooms.

The sub-tank 100 shown in FIG. 5 may be provided with only one partition wall (either of the partition walls 101A and 101B), or may be provided with more than two partition walls.

The present invention can be applied not only to the inkjet printer 1 shown in FIG. 1 but can be applied to any other inkjet printer in which a sub-tank of the ink is disposed above an inkjet head and reciprocated integrally with the inkjet head by a carriage to print a desired image on a recording medium such as a cloth, a plastic sheet, and a paper sheet.

The present disclosure relates to the subject matter contained in Japanese Patent Application No. P2003-84515, filed on Mar. 26, 2003, which is expressly incorporated herein by reference in its entirety.

What is claimed is:

1. An inkjet printer, comprising:

an inkjet head that ejects ink onto a recording medium;

a movable ink tank having an ink introducing opening, an ink storing space in which ink introduced through the ink introducing opening is stored, and an ink discharging opening through which the ink of the ink storing space is supplied to the inkjet head; and a carriage supporting the inkjet head and the movable ink tank, the carriage reciprocating in a direction perpendicular to a feeding direction of the recording medium, wherein the movable ink tank includes a partition wall that divides the ink storing space into multiple rooms, the multiple rooms being arranged in a direction parallel to a reciprocating direction of the carriage, the multiple rooms being in fluid communication with each other only at upper portions thereof, the partition wall having a portion extending in a direction substantially perpendicular to the reciprocating direction of the carriage, and the upper portions of the multiple rooms being located opposite and distal from the inkjet head in the direction substantially perpendicular to the reciprocating direction of the carriage.

2. The inkjet printer according to claim 1, wherein the partition wall divides the ink storing space into a first ink room being in fluid communication with the ink introducing opening and a second ink room being in fluid communication with the ink discharging opening.

3. The inkjet printer according to claim 1, further comprising:

a stationary ink tank; and a tube that connects the movable ink tank with the stationary ink tank to supply ink of the stationary ink tank into the movable ink tank.

4. The inkjet printer according to claim 1, wherein the partition wall consists of the portion which is substantially perpendicular to the reciprocating direction of the carriage.

5. The inkjet printer according to claim 4, wherein the ink introducing opening is arranged so that the ink is introduced into the movable ink tank in parallel with the partition wall.

6. The inkjet printer according to claim 1, wherein at least a portion of a side wall of the movable ink tank is flexible.

7. The inkjet printer according to claim 6, wherein the flexible portion of the side wall of the movable ink tank faces the partition wall.

8. The inkjet printer according to claim 1, wherein one of the multiple rooms of the movable ink tank is in fluid communication with the ink introducing opening and has a side wall of which portion facing the partition wall is flexible.

9. The inkjet printer according to claim 1, wherein the ink introducing opening is located lower than a top edge of the partition wall.

10. The inkjet printer according to claim 1, wherein the movable ink tank includes multiple divider plates protruding downward from respective ceilings of the multiple rooms defined in the ink storing space.

11. The inkjet printer according to claim 1, wherein the movable ink tank includes a divider plate protruding downward from a ceiling of the ink storing space, the divider plate dividing an upper part of one of the multiple rooms defined in the ink storing space.

12. The inkjet printer according to claim 11, wherein a lower end of the divider plate is located lower than a top edge of the partition wall.

13. The inkjet printer according to claim 12, wherein a lower end portion of the divider plate and an upper end portion of the partition wall face each other.

14. The inkjet printer according to claim 1, wherein at least a part of at least one side of the movable ink tank is light transmissive.

15. The inkjet printer according to claim 14, further comprising an optical liquid level sensor that detects the ink level within the movable ink tank through the light transmissive part of the movable ink tank.

16. The inkjet printer according to claim 1, wherein one of the multiple rooms of the movable ink tank is in fluid communication with the ink discharging opening and has a side wall of which portion facing the partition wall is light transmissive.

17. The inkjet printer according to claim 16, further comprising an optical liquid level sensor that detects the ink level within the movable ink tank through the light transmissive portion.

18. The inkjet printer according to claim 1, wherein the movable ink tank further comprises:

a first ink room that receives the ink from a stationary ink source; and a second ink room that receives the ink from the first ink room and supplies the ink to the inkjet head, wherein both the first and second ink rooms are formed narrower in a reciprocating direction of the inkjet head than in a direction perpendicular to the reciprocating direction.

19. The inkjet printer according to claim 18, wherein the first and second ink rooms are arranged in the reciprocating direction and separated from each other with a plate like wall formed perpendicular to the reciprocating direction.

20. The inkjet printer according to claim 19, wherein at least a part of a side wall of the first ink room facing the plate like wall has flexibility to absorb pressure fluctuation in the ink within the first ink room.

21. The inkjet printer according to claim 20, wherein the at least a part of the side wall of the first ink room is a flexible film.

22. The inkjet printer according to claim 19, wherein at least a part of a side wall of the second ink room facing the plate like wall is light transmissive.

23. The inkjet printer according to claim 22, wherein the at least a part of the side wall of the second ink room is a light transmissive film.

24. The inkjet printer according to claim 18, wherein an opening is formed above the plate like wall to allow the ink in the first ink room to flow into the second ink room over the plate like wall.

25. The inkjet printer according to claim 18, further comprising an ink introducing channel that introduces the ink from the stationary ink source into a lower part of the first ink room.

26. The inkjet printer according to claim 25, wherein the lower part of the first ink room includes an expanded portion that expands in a direction perpendicular to the reciprocating direction.

27. The inkjet printer according to claim 25, wherein the ink introducing channel introduces the ink into the first ink room vertically downward.

28. The inkjet printer according to claim 25, wherein the first and second ink rooms are arranged in the reciprocating direction and separated from each other with a plate like wall formed perpendicular to the reciprocating direction, and wherein the ink introducing channel introduces the ink into the first ink room in parallel with the reciprocating direction.

29. The inkjet printer according to claim 18, further comprising an ink discharging opening formed on a bottom of the second ink room for discharging the ink into the inkjet head.

30. The inkjet printer according to claim 18, further comprising a divider that divides a surface of the ink in one of the first and second ink rooms into smaller areas.

31. The inkjet printer according to claim 30, wherein the divider divides the surface of the ink in the reciprocating direction.

32. The inkjet printer according to claim 30, wherein the divider divides the surface of the ink into substantially halves.

33. The inkjet printer according to claim 30, wherein the divider is a plate extending perpendicularly to the reciprocating direction.

34. The inkjet printer according to claim 33, wherein the plate protrudes downward from a ceiling of one of the first and second ink rooms.

35. An inkjet printer, comprising:

an inkjet head that ejects ink onto a recording medium;

a movable ink tank having an ink introducing opening, an ink storing space in which ink introduced through the ink introducing opening is stored, and an ink discharging opening through which the ink of the ink storing space is supplied to the inkjet head; and a carriage that supports the inkjet head and the movable ink tank, the carriage reciprocating in a direction perpendicular to a feeding direction of the recording medium, wherein the movable ink tank includes a partition wall that divides the ink storing space into multiple rooms, the multiple rooms being arranged in a direction parallel to a reciprocating direction of the carriage, the multiple rooms being in fluid communication with each other at upper portions thereof, the partition wall having a portion extending in a direction substantially perpendicular to the reciprocating direction of the carriage, and wherein the partition wall is flexible.

36. An inkjet printer, comprising:

an inkjet head that ejects ink onto a recording medium;

a movable ink tank having an ink introducing opening, an ink storing space in which ink introduced through the ink introducing opening is stored, and an ink discharging opening through which the ink of the ink storing space is supplied to the inkjet head; wherein at least a part of at least one side of the movable ink tank is light transmissive; and wherein the light transmissive part of the movable ink tank is flexible;

a carriage that supports the inkjet head and the movable ink tank, the carriage reciprocating in a direction perpendicular to a feeding direction of the recording medium, wherein the movable ink tank includes a partition wall that divides the ink storing space into multiple rooms, the multiple rooms being arranged in a direction parallel to a reciprocating direction of the carriage, the multiple rooms being in fluid communication with each other at upper portions thereof, the partition wall having a portion extending in a direction substantially perpendicular to the reciprocating direction of the carriage.

37. An inkjet printer, comprising:

an inkjet head that ejects ink onto a recording medium;

a movable ink tank having an ink introducing opening, an ink storing space in which ink introduced through the ink introducing opening is stored, and an ink discharging opening through which the ink of the ink storing space is supplied to the inkjet head; and a carriage that supports the inkjet head and the movable ink tank, the carriage reciprocating in a direction perpendicular to a feeding direction of the recording medium, wherein the movable ink tank includes a partition wall that divides the ink storing space into multiple rooms, the multiple rooms being arranged in a direction parallel to a reciprocating direction of the carriage, the multiple rooms being in fluid communication with each other at upper portions thereof, the partition wall having a portion extending in a direction substantially perpendicular to the reciprocating direction of the carriage, wherein one of the multiple rooms of the movable ink tank is in fluid communication with the ink discharging opening and has a side wall of which portion facing the partition wall is light transmissive, and wherein the light transmissive portion is flexible.

38. An ink tank, to be connected with an inkjet head for supplying ink to and moving integrally with the inkjet head when the inkjet head reciprocates to print on an object, the ink tank comprising:

a first ink room that receives the ink from a stationary ink source; and a second ink room that receives the ink from the first ink room and supplies the ink to the inkjet head, wherein both the first and second ink rooms are formed narrower in a reciprocating direction of the inkjet head than in a direction perpendicular to the reciprocating direction wherein the said first and second ink rooms are arranged in the reciprocating direction and separated from each other with a plate like wall formed perpendicular to the reciprocating direction, and wherein the plate like wall has flexibility to absorb pressure fluctuation in the ink within the first and second ink rooms.

39. The ink tank according to claim 38, wherein the plate like wall is a flexible film.

40. An ink tank to be connected with an inkjet head for supplying ink to and moving integrally with the inkjet head when the inkjet head reciprocates to print on an object, the ink tank comprising:

a first ink room that receives the ink from a stationary ink source; and a second ink room that receives the ink from the first ink room and supplies the ink to the inkjet head, wherein both the first and second ink rooms are formed narrower in a reciprocating direction of the inkjet head than in a direction perpendicular to the reciprocating direction, wherein the first and second ink rooms are arranged in the reciprocating direction and separated from each other with a plate like wall formed perpendicular to the reciprocating direction, wherein at least a part of a side wall of the first ink room facing the plate like wall has flexibility to absorb pressure fluctuation in the ink within the first ink room, wherein the at least a part of the side wall of the first ink room is a flexible film, and wherein the film is a light transmissive film.

41. An ink tank to be connected with an inkjet head for supplying ink to and moving integrally with the inkjet head when the inkjet head reciprocates to print on an object, the ink tank comprising:

a first ink room that receives the ink from a stationary ink source;

a second ink room that receives the ink from the first ink room and supplies the ink to the inkjet head;

wherein both the first and second ink rooms are formed narrower in a reciprocating direction of the inkjet head than in a direction perpendicular to the reciprocating direction;

wherein the first and second ink rooms are arranged in the reciprocating direction and separated from each other with a plate like wall formed perpendicular to the reciprocating direction;

wherein at least a part of a side wall of the second ink room facing the plate like wall is light transmissive;

wherein the at least a part of the side wall of the second ink room is a light transmissive film; and wherein the film is flexible.

42. An ink tank connected with an inkjet head to supply ink to an inkjet head, the ink tank and the inkjet head being mounted on a movable carriage which is reciprocally movable along a horizontal direction, the ink tank comprising:

an ink introducing opening, an ink storing space in which ink introduced through the ink introducing opening is stored, an ink discharging opening through which the ink of the ink storing space is supplied to the inkjet head;

a partition wall that divides the ink storing space into multiple rooms, the multiple rooms being arranged in a direction parallel to a reciprocating direction of the carriage, the multiple rooms being in fluid communication with each other only at upper portions thereof, the partition wall having a portion extending in a direction substantially perpendicular to the reciprocating direction of the carriage, and the upper portions of the multiple rooms being located opposite and distal from the inkjet head in the direction substantially perpendicular to the reciprocating direction of the carriage, and further comprising at least one divider including a plate extending perpendicularly to the reciprocating direction of the carriage and protruding downward, toward one of the multiple rooms, from a ceiling of the ink storing space, a lower end portion of the at least one divider facing an upper end portion of the partition wall.

* * * * *